United States Patent [19]

Weissenfels

[11] Patent Number: 4,615,439

[45] Date of Patent: Oct. 7, 1986

[54] CONTAINER HAVING A REMOVABLE SEALING COVER

[75] Inventor: Dieter Weissenfels, Mainz-Kastel, Fed. Rep. of Germany

[73] Assignee: Werner & Mertz GmbH, Mainz, Fed. Rep. of Germany

[21] Appl. No.: 766,299

[22] Filed: Aug. 16, 1985

[30] Foreign Application Priority Data

Aug. 17, 1984 [DE] Fed. Rep. of Germany ... 8424461[U]

[51] Int. Cl.[4] ..... B65D 69/00

[52] U.S. Cl. ..... 206/229; 206/15.2; 206/15.3; 206/581

[58] Field of Search ..... 206/229, 235, 277, 581, 206/15.2, 15.3; 220/408, 410; 132/84 B

[56] References Cited

U.S. PATENT DOCUMENTS

| | | | |
|---|---|---|---|
| 3,681,806 | 8/1972 | Han | 206/229 |
| 4,023,677 | 5/1977 | Wittner et al. | 206/229 |
| 4,162,010 | 7/1979 | Hovsepian | 206/229 |
| 4,384,645 | 5/1983 | Manfredi | 206/229 |

*Primary Examiner*—Joseph Man-Fu Moy

*Attorney, Agent, or Firm*—Burns, Doane, Swecker & Mathis

[57] ABSTRACT

In a container having a removable sealing cover and, attached thereto, an application device for the contents of the container, in particular shoe polish, the seal is improved by providing, along the entire periphery of the container and in addition along the periphery of each compartment, a sealing lip which cooperates with corresponding sealing lips on the cover. To improve the usefulness, the cover or the bottom section of the container is additionally provided with a brush.

16 Claims, 8 Drawing Figures

CONTAINER HAVING A REMOVABLE SEALING COVER

FIELD OF THE INVENTION

The innovation relates to a container having a removable sealing cover according to the precharacterising clause of claim 1.

OBJECT AND SUMMARY OF INVENTION

The innovation is based on the object of developing a container of this type so that the seal and the usefulness are improved.

This object is achieved according to a preferred embodiment of the present invention in a container having a removable sealing cover and, attached thereto, an application device for the contents of the container, in particular shoe polish, wherein the seal is improved by providing, along the entire periphery of the container and in addition along the periphery of each compartment, a sealing lip which cooperates with corresponding sealing lips on the cover. To improve the usefulness, the cover or the bottom section of the container is additionally provided with a brush. The separate seal of the individual compartments in the container and the additional seal around the two compartments prevent premature drying up of both the applicator tool and the shoe polish present in the container.

The description which follows and the further claims represent advantageous developments of the innovation.

BRIEF DESCRIPTION OF THE DRAWING

A preferred embodiment of the innovation is explained in more detail by reference to the drawing in which.

DETAILED DESCRIPTION OF THE PREFERRED EMBODIMENT

Figure 1:
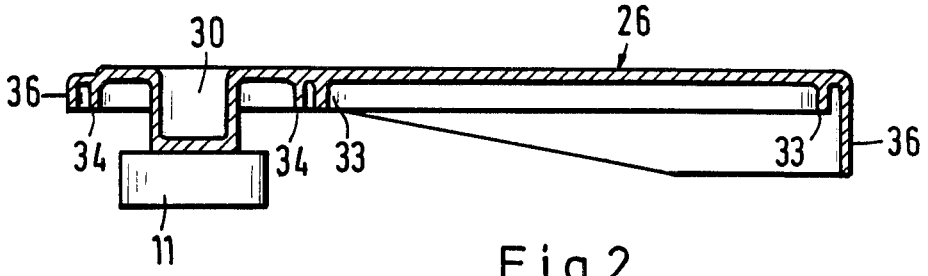
FIG. 1 is the cover of the container, in a longitudinal section.

In the preferred embodiment illustrated, the cover 26 and the bottom section 27 of the container are injection-moulded from plastics. The elongate shoe polish compartment 28 is shallower than the compartment 29 intended for the applicator tool, for example a circular disc-shaped sponge 11. A pot-shaped contraction 30 on the cover 26 has a diameter smaller than that of the applicator sponge 11 and is so long and deep respectively that the applicator sponge 11 can penetrate without difficulty down to the bottom of the shoe polish compartment 28.

The compartments 28 and 29 are provided along their periphery with a sealing lip 31 and 32 respectively projecting upwards. Corresponding sealing lips are formed on the inner side of the cover, the sealing lip 33 corresponding to the shape of the compartment 28 and bearing sealingly around the sealing lip 31 when the cover is put in place. In a corresponding manner, a sealing lip 34 around the applicator sponge 11 is provided on the cover 26, which sealing lip 34 comes to rest sealingly against the sealing lip 32 of the bottom section. Further, an upwardly projecting sealing lip 35 is formed over the entire periphery of the bottom section, the outer edge 36 of the cover engaging with this sealing lip 35 so as to produce an additional seal. Here, the downwardly projecting outer edge 36 of the cover 26 likewise serves as a sealing lip. In this way, a double seal is provided for the compartment 28 and for the compartment 29.

Figure 2:
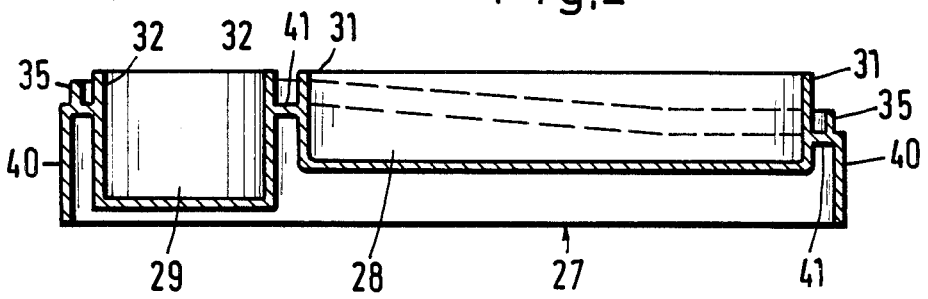
FIG. 2 is the bottom section of the container, in a longitudinal section.
Figure 3:
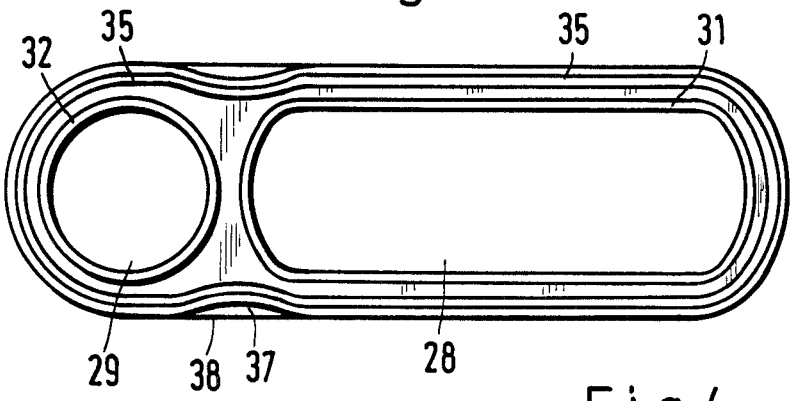
FIG. 3 is a plan view of the bottom section of the container.
Figure 4:
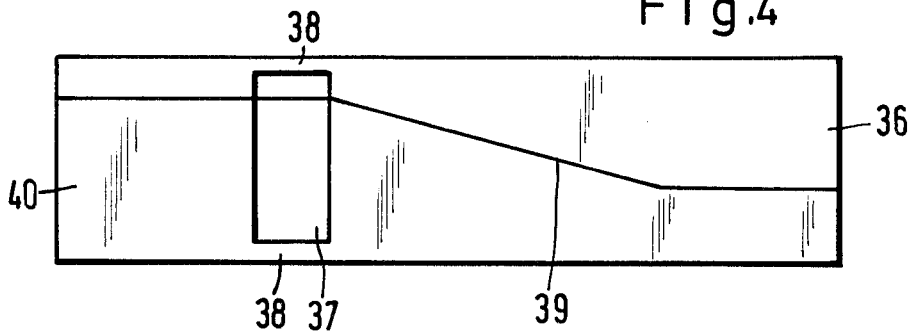
FIG. 4 is a side view of the closed container.

As can be seen in FIGS. 3 and 4, a bilateral indentation 37 is formed both on the cover 26 and on the bottom section 27 between the two compartments, the indentation being delimited on the top and on the bottom by a web 38 of the outer wall. This design facilitates opening of the container and handling. The separating line between the lid and the bottom section runs obliquely downwards, at 39, so that a durable handle is formed on the cover. The outer sealing lips 35, 36 follow these obliquely running separating lines 39. As is evident from the sectional views in FIGS. 1 and 2, the wall thickness is essentially the same throughout on the cover and on the bottom section. The two compartments 28, 29 project into the hollow bottom section which is open at the bottom and is formed by an outer wall 40 and an upper wall 41 following the path of the separating line. The inner sealing lips 31, 32 and the outer sealing lip 35 project from this upper wall 41. The cover 26 is of corresponding design, the outer wall 36 at the same time forming the sealing lip and following the separating line.

Instead of the sealing lips which come to rest against one another when the container is closed, it is also possible for a groove to be formed on a container part, into which groove a sealing lip on the opposite part engages. It is furthermore possible to make the sealing lips resilient to improve the seal or to provide them with a separate seal.

The container with cover described is advantageous not only for shoe polish and other polishes but can also be used for other purposes, for example for the application of ointments and cosmetic agents.

The diameter of the applicator sponge 11 substantially corresponds to the width of the compartment 28 and the rounding at the ends of the compartment 28 substantially corresponds to the radius of the applicator tool, so that the compartment 28 can be completely emptied. However, it is also possible to make the applicator sponge 11 or another applicator tool, such as for example felt or a brush, smaller than the cross-sectional form of compartment 28.

Figure 5:
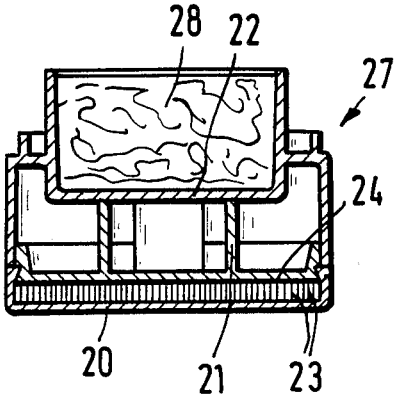
FIGS. 5 and 6 are a cross-section through the bottom section of another embodiment.
Figure 6:
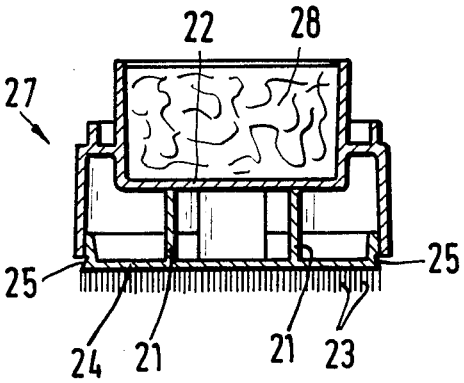

In the embodiment of FIGS. 5 and 6, a plate 24 provided with a brush 23 is inserted in the open underside of the bottom section 27 and is supported via webs 21 on the bottom 22 of the compartment 28. The plate 24 is provided on the periphery with a flange-like extension in which a groove 25 is formed. A cover 20 which after use covers the brush 23, as is shown in FIG. 5, can be pushed into this groove 25.

Figure 7:
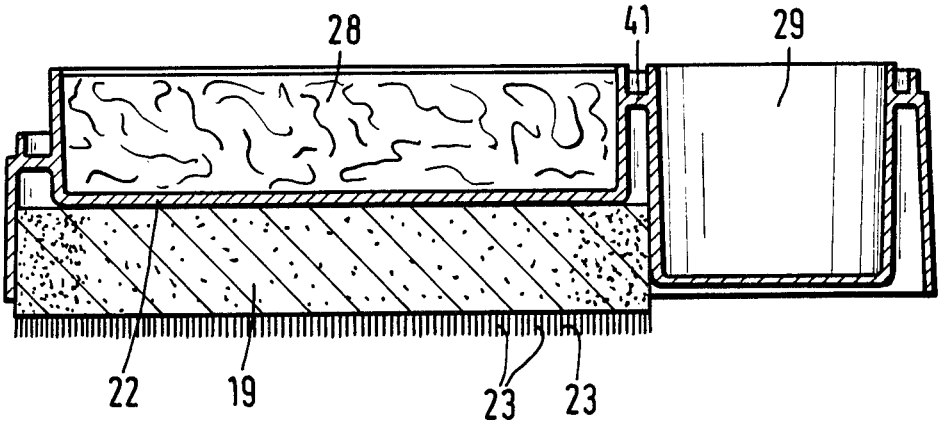
FIG. 7 is a longitudinal section through the bottom section of a further embodiment.

In the embodiment of FIG. 7, a sponge 19 provided on one side with the brush 23 is inserted at the open underside of the bottom section 27. The sponge 19 can be removed and inserted such that the brush 23 lies on the inside and is hence covered.

Figure 8:
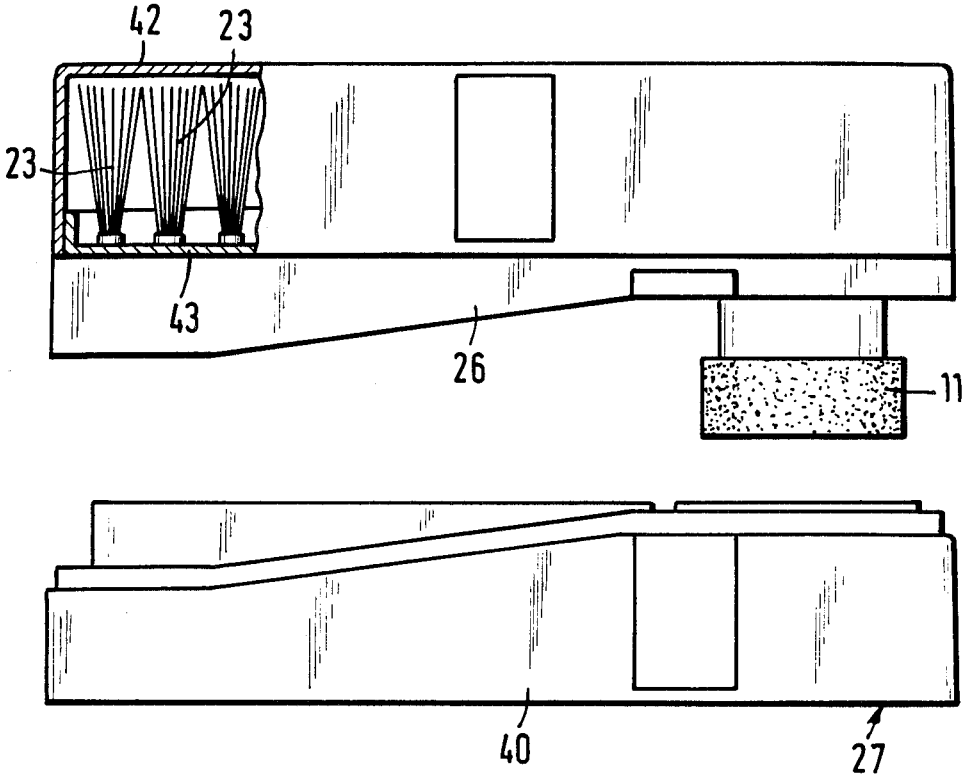
FIG. 8 is a partially cut-open side view of the cover of a further embodiment.

FIG. 8 shows an embodiment in which the brush 23 is fitted at the upper side of the cover 26 and covered by a removable cover hood 42. The brush is attached to a plate 43 which is fixed, for example by glueing, onto the upper side of the cover 26 and is provided on the periphery with a projecting edge section over which the cover hood 42 engages. In the arrangement of FIG. 8 the cover hood 42 in conjunction with the cover 26 forms a handle for the applicator sponge 11. When the brush 23 is in use, the cover 26 is placed onto the bottom section 27 and the cover hood 42 is removed so that the cover 26 together with bottom section 27 form a handle for the brush 23.

In the embodiments according to FIGS. 5 to 8, all the components necessary for polishing shoes are accommodated in one apparatus. A design of this type is particularly suitable for travel purposes because the shoe polish and necessary tools can be accommodated in a suitcase in a space-saving manner.

In the embodiment of FIGS. 5 and 6, the plate 24 can be inserted by means of a clip connection at the underside of the bottom section 27. The slideable cover 20 can moreover be pushed open in a similar way to the cover 42 in FIG. 8. Likewise, the brush 23 can be inserted, similarly to the embodiment of FIG. 8, at the underside of the bottom 22 in FIGS. 5 and 6, the bristles which project beyond the lower edge of the bottom section 27 being covered by a cover hood.

The brush 23 can in each case also extend over a part region of the cover 26 or the bottom section 27.

The brush 23 can also be located on one of the side surfaces of the cover 26 or of the bottom section 27.

Instead of the foam plastic part 19 it is also possible to provide another resilient part carrying the brush, which can easily be introduced into and removed again from the container.

The brush is preferably attached so that it can be detached from the container and reinserted into another container of the same type when, for example, the contents of the container are used up and a new container is procured.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A container comprising a bottom section, a removable sealing cover and an application device attached to the removable sealing cover for applying contents of the container, the cover of the container having an elongate cross-section so as to define a handle for the application device, the application device including an applicator which extends into a chamber of the bottom section, said chamber adjacent to a shoe polish compartment of the bottom portion, said bottom portion including sealing lips formed around the chamber and the compartment, the sealing lips engaging with corresponding sealing lips on the cover, a sealing lip formed along a periphery of the bottom section engaging a corresponding sealing lip on the cover.

2. The container according to claim 1, wherein a connection between the cover and the applicator projects the applicator from the cover a distance greater than a depth of the compartment.

3. The container according to claim 2, wherein the cover and the bottom section are injection molded and have substantially the same wall thickness throughput.

4. The container according to claims 3, wherein the container is elongated and a line of separation between the cover and the bottom section includes an oblique portion at a middle region of the container.

5. The container according to claim 4, wherein an indentation is provided on opposite side walls of the container in a region between the chamber and the compartment.

6. The container according to claim 5, further comprising a brush provided on one of the cover and the bottom section.

7. The container according to claim 6, wherein the brush is is provided at an underside of the bottom section, said bottom section provided with a removable cover member which covers the brush.

8. The container according to claim 6, wherein said bottom section includes an open underside and a resilient part which is removably inserted into the open underside of the bottom section, one side of the resilient part being provided with the brush.

9. The container according to claim 6, wherein the brush is attached to an upper side of the cover and said cover is provided with a removable hood which covers said brush.

10. The container according to claim 8, wherein said resilient part is made from foam plastic.

11. The container according to claim 1, wherein said applicator includes a brush.

12. The container according to claim 1, wherein said applicator includes a sponge.

13. The container according to claim 11, wherein said contents includes shoe polish.

14. The container according to claim 12, wherein said contents includes shoe polish.

15. The container according to claim 1, wherein the cover and the brush section are injection molded and have substantially the same wall thickness throughout.

16. The container according to claim 1, wherein the container is elongated and a line of separation between the cover and the bottom section includes an oblique portion at a middle region of the container.

* * * * *